US010418677B2

(12) United States Patent
Park et al.

(10) Patent No.: US 10,418,677 B2
(45) Date of Patent: Sep. 17, 2019

(54) RADIO FREQUENCY FILTER HAVING A RESONANCE ELEMENT WITH A THREADED SUPPORT AND A PLANAR PLATE INCLUDING AT LEAST TWO THROUGH HOLES THEREIN

(71) Applicant: KMW INC., Hwaseong-si (KR)

(72) Inventors: Nam-Shin Park, Hwaseong-si (KR); Byeong-Chul Kim, Osan-si (KR); Dae-Soo Jeong, Gwangju-si (KR)

(73) Assignee: KMW INC., Hwaseong-si (KR)

( * ) Notice: Subject to any disclaimer, the term of this patent is extended or adjusted under 35 U.S.C. 154(b) by 0 days.

(21) Appl. No.: 15/789,953

(22) Filed: Oct. 20, 2017

(65) Prior Publication Data

US 2018/0048043 A1 Feb. 15, 2018

Related U.S. Application Data

(63) Continuation of application No. PCT/KR2016/001537, filed on Feb. 16, 2016.

(30) Foreign Application Priority Data

Apr. 20, 2015 (KR) ..... 10-2015-0055070

(51) Int. Cl.
*H01P 1/205* (2006.01)
*H01P 7/06* (2006.01)
(Continued)

(52) U.S. Cl.
CPC ..... *H01P 1/2053* (2013.01); *H01P 1/207* (2013.01); *H01P 7/04* (2013.01); *H01P 7/06* (2013.01)

(58) Field of Classification Search
CPC ..... H01P 1/205; H01P 1/2053; H01P 7/04
(Continued)

(56) References Cited

U.S. PATENT DOCUMENTS 2,516,056 A * 7/1950 Keizer ..... H01P 1/205 333/203
6,452,466 B1 * 9/2002 Henningsson et al. ... H01P 7/04 333/206
7,388,457 B2 * 6/2008 Pance et al. ..... H01P 1/2084 333/202

FOREIGN PATENT DOCUMENTS

JP 2011-097463 A 5/2011
KR 10-2004-0020683 A 3/2004
(Continued)

OTHER PUBLICATIONS

International Search Report for PCT/KR2016/001537, dated May 20, 2016, and its English translation.
(Continued)

*Primary Examiner* — Benny T Lee

(57) ABSTRACT

The present disclosure provides a radio frequency filter having a cavity structure including a housing, a cover and a resonance element. The housing has a hollow interior for providing a cavity, and an open side. The cover shields the open side of the housing. The resonance element is positioned in the hollow interior of the housing, and has a planar portion and a support for supporting and fixing the planar portion to the housing. The planar portion of the resonance element has at least two through holes, and the support has a lower end portion formed with a male thread structure for screw fastening. The housing is formed with a female thread structure to be screw fastened with the male thread structure formed at the lower end portion of the support.

12 Claims, 5 Drawing Sheets

(51) Int. Cl.
*H01P 1/207* (2006.01)
*H01P 7/04* (2006.01)

(58) Field of Classification Search
USPC ..... 333/203, 223
See application file for complete search history.

(56) References Cited

FOREIGN PATENT DOCUMENTS

| | | | |
|---|---|---|---|
| KR | 10-2004-0100084 | A | 12/2004 |
| KR | 10-2014-0026235 | A | 3/2014 |
| WO | 2012-162948 | A1 | 12/2012 |
| WO | 2015-018051 | A1 | 2/2015 |

OTHER PUBLICATIONS

International Written opinions for PCT/KR2016/001537, dated May 20, 2016, and its English translation.

* cited by examiner

RADIO FREQUENCY FILTER HAVING A RESONANCE ELEMENT WITH A THREADED SUPPORT AND A PLANAR PLATE INCLUDING AT LEAST TWO THROUGH HOLES THEREIN

CROSS-REFERENCE TO RELATED APPLICATION

This application is a Continuation of International Application No. PCT/KR2016/001537, filed on Feb. 16, 2016, which claims the benefit of and priority to Korean Patent Application No. 10-2015-0055070, filed on Apr. 20, 2015, which are herein incorporated by reference in their entirety.

TECHNICAL FIELD

The present disclosure in some embodiments relates to a radio signal processing apparatus used in a radio communication system. More particularly, the present disclosure relates to a radio frequency filter having a cavity such as a cavity filter.

BACKGROUND

A radio frequency filter having a cavity generally utilizes a metallic housing which provides a plurality of accommodation spaces or cavities having a shape such as rectangular parallelepiped and the like, in which dielectric resonance elements (DR) or resonance elements having a metallic resonance rod are each provided to generate super high frequency resonance. Some radio frequency filters employ a structure that generates resonance by the shape of the cavity itself without using the dielectric resonance element. Further, a radio frequency filter having a cavity is generally equipped, at its upper portion, with a cover to enclose the open areas of the corresponding cavities, where the cover may have, as a configuration for tuning the filtering characteristic of the radio frequency filter, a plurality of tuning screws and nuts for fixing the corresponding tuning screws. An exemplary radio frequency filter having a cavity is disclosed in Korean Patent Application Publication No. 10-2004-100084 (entitled "Radio Frequency Filter" and published on Dec. 2, 2004; inventors: Park, Jonggyu et al.) filed by the present applicant.

Radio frequency filters having such a cavity are used for processing radio signals transmitted and received in a radio communication system. The radio frequency filters are typically used for base stations, repeaters or relays and the like particularly in mobile communication systems.

Meanwhile, a base station or a repeater of a mobile communication system usually comprises an antenna device installed on a pole at a higher location above the ground, and a main unit linked to such an antenna unit typically through a cable. In recent years, due to continuous technical developments for weight reduction and miniaturization of equipments for processing radio signals, an installation method in use involves installing at least some modules of the main units on a mounting pole for the antenna device, and arranging the modules to be directly linked with or included in the antenna device.

Therefore, in manufacturing a radio frequency filter applicable for use with such a base station or a repeater of the mobile communication system, miniaturization and weight reduction are emerging as more important considerations.

However, the radio frequency filter having a cavity suffers from limitations in achieving the desired weight reduction and miniaturization because the filter needs to be structured for providing a housing typically with a resonance element installed and to basically have a coupling structure of the housing with a cover. Further, considering a filter design that reduces the overall dimension of the cavity and the resonance element for light weight and miniaturization, the mechanical shapes and sizes required to stably and fixedly couple and install the resonance element in the cavity counteract the desire for weight reduction and miniaturization of the radio frequency filter.

DISCLOSURE

Technical Problem

Therefore, at least one embodiment of the present disclosure seeks to provide a radio frequency filter having a cavity that can be made more compact and light weight.

In another embodiment, the present disclosure seeks to provide a radio frequency filter which minimizes the mechanical form and size required to stably fix and couple the resonance element in the cavity.

SUMMARY OF THE INVENTION

In accordance with some embodiments of the present disclosure, a radio frequency filter having a cavity includes a housing, a cover and at least one resonance element. The housing has a hollow internal space for providing at least one cavity, and an open side. The cover is configured to enclose the open side of the housing. The at least one resonance element is disposed in the hollow internal space of the housing and has a planar portion and a support fixed to the housing and supporting the planar portion. The planar portion of the at least one resonance element has at least two through holes formed so as to be connected to an external driver device and rotate a corresponding resonance element, and the support has a lower end formed with a male thread for screw fastening. Furthermore, the housing is formed with a female thread to be screw fastened with the male thread formed at the lower end of the support for fixing the support.

The external driver device may include at least two pins configured to be at positions corresponding to the at least two through holes formed in the planar portion, and to be inserted in the at least two through holes for an engagement with the at least two through holes.

Advantageous Effects

As described above, a radio frequency filter having a cavity according to at least one embodiment of the present disclosure can be made more compact and lightweight. The radio frequency filter has minimized mechanical form and size required to stably fix and couple the resonance element within the cavity, and it can be made in a plain, simplified structure.

In addition, there is an advantage that the miniaturized and lightweight radio frequency filter can be easily installed in a station such as a base station.

DETAILED DESCRIPTION OF THE INVENTION

Some embodiments of the present disclosure will now be described in detail with reference to the accompanying drawings.

Figure 1:
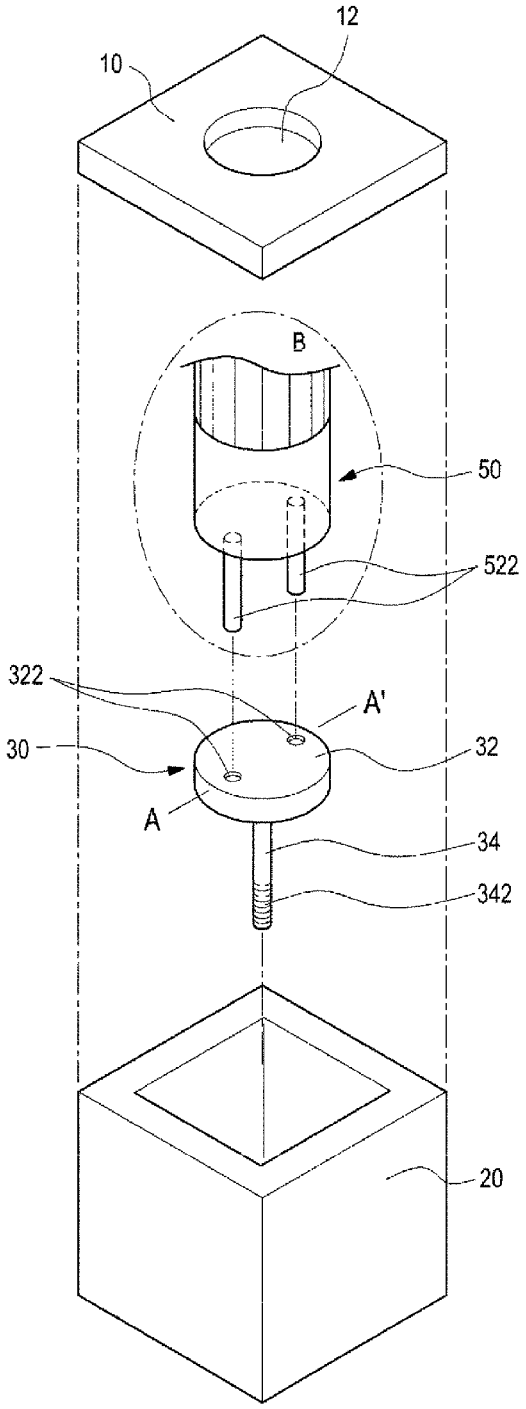
FIG. 1 is a partially exploded perspective view of a radio frequency filter having a cavity according to a first embodiment of the present disclosure.
Figure 2:
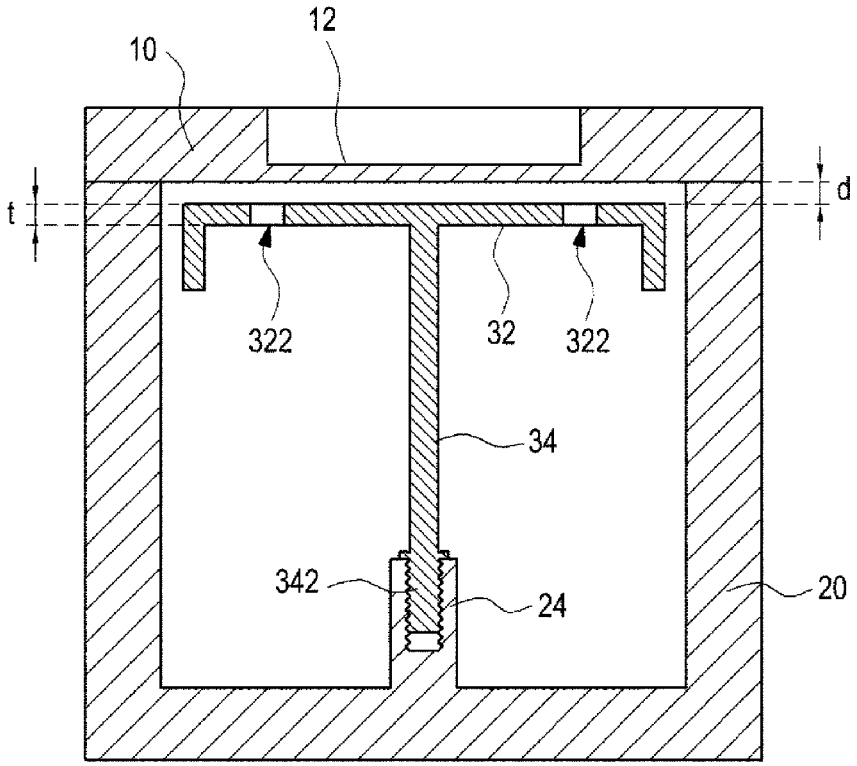
FIG. 2 is a sectional view taken along line A-A' of the radio frequency filter in FIG. 1.
Figure 3:
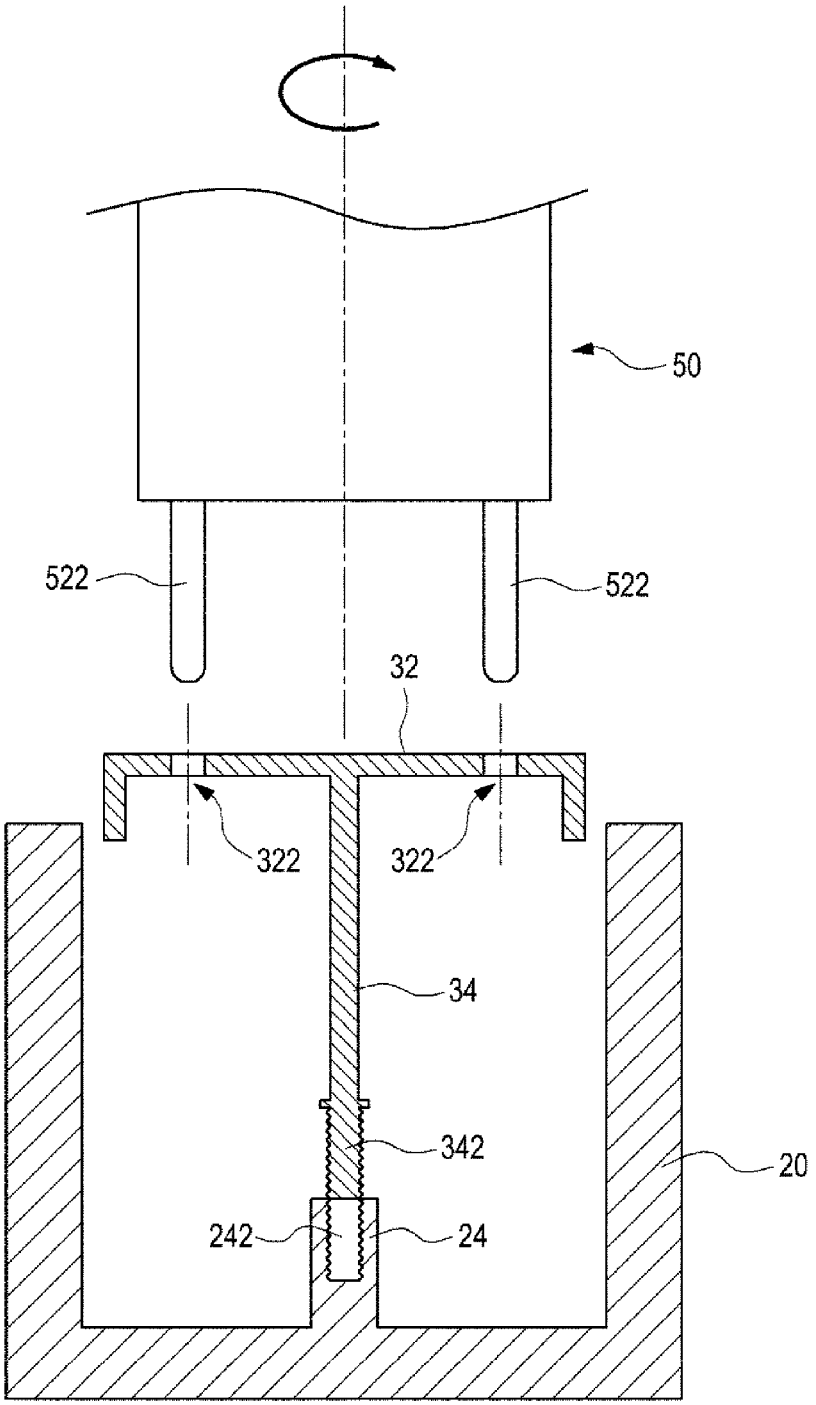
FIG. 3 is a diagram illustrating an installation process performed on a resonance element in the radio frequency filter in FIG. 2.

FIG. 1 is a partially exploded perspective view of a radio frequency filter having a cavity according to a first embodiment of the present disclosure, wherein the dot-dash circle B shows an additional driver device 50 as a work tool for the installation process of a resonance element 30 for the sake of convenience of explanation. FIG. 2 is a sectional view taken along line A-A' of the radio frequency filter in FIG. 1, which is completely assembled. FIG. 3 is a diagram illustrating the installation process performed on the resonance element in the radio frequency filter in FIG. 2 before its housing 20 is fitted with a cover 10 shown in FIG. 2.

Referring to FIGS. 1 to 3, the radio frequency filter having the cavity according to the first embodiment of the present disclosure, while seemingly similar to prior art, is provided with an enclosure that has at least one cavity which is a hollow internal space and is isolated from the outside. The enclosure is formed to include the housing 20, and the housing 20 has at least one cavity and an opening at one side (for example, at the upper side), and the cover 10 (FIGS. 1 and 2) for enclosing the open side of the housing 20. FIGS. 1 to 3 illustrate an exemplary basic structure in which, for example, a single cavity is formed in the housing 20. In addition, the cavity is provided with one resonance element 30 (FIG. 1), for example, at the center thereof. The housing 20 may be additionally formed, on two side surfaces, with conventional input/output terminals (not shown) for signal input/output to and from the radio frequency filter.

The housing 20 and the cover 10 may be made of a material such as aluminum (alloy) or others, and, in order to improve the electrical characteristics, at least the surface forming the cavity may be plated with silver or copper. The resonance element 30 may also be made of a material such as aluminum (alloy), iron (alloy) or others, and it may be plated with silver or copper.

The physical structure of the cavity formed in the housing 20 and the cover 10 of the radio frequency filter according to the first embodiment of the present disclosure and the installment process of the resonance element 30 into the cavity may appear to be relatively similar to the prior art, except that they can be miniaturized in implementation. The improvement over the conventional structure, however, lies in the resonance element 30 and the installation process thereof, according to at least one embodiment of the present disclosure.

More specifically, the resonance element 30 includes a planar portion 32 that forms, as a circuit component, a capacitor (C) of the filter and has, for example, a circular planar shape. The resonance element 30 additionally includes a rod-like support 34 that forms, as a circuit component, an inductor (L) and has a circular cross section. The support 34 has an upper end formed to be connected with the bottom of the planar portion 32 and a lower end installed fixedly and coupled with a threaded recess 242 (FIG. 3) provided at the bottom of the enclosure, i.e., the housing 20 to support the planar portion 32.

In the present embodiment, the lower end of the support 34 of the resonance element 30 is formed with a male thread 342 as a means for threaded coupling. In an arrangement complementary to the male thread 342, the housing 20 is provided with a female thread 24 (FIGS. 2 and 3) to be screw connected to the male thread 342 formed at the lower end of the support 34 for fixing the latter. The female thread 24 is formed, for example, to protrude from the housing 20 at a portion corresponding to the bottom of the cavity.

At least two through holes 322 are appropriately formed at the planar portion 32 of the resonance element 30 at points symmetrical to each other with respect to, for example, the center of the planar portion 32. The through holes 322 are configured to be engaged, when performing the installation process of the resonance element 30, with an external device, that is, the driver device 50 (FIGS. 1 and 2) for rotating the resonance element 30, and thereby the male thread 342 formed on the support 34 of the housing 30 is screwed into the internal thread 24.

The driver device 50 (FIGS. 1 and 2) has at least two coupling pins 522 (FIGS. 1 and 2) disposed at locations corresponding to the at least two through holes 322 formed at the planar portion 32 of the resonance element 30. Each of the coupling pins 522 (FIGS. 1 and 2) has a suitable size and a shape to be inserted into the through holes 322 to establish an interconnection therebetween, as shown in FIGS. 1 and 3. With the driver device 50 (FIGS. 1 and 2), an operator may rotate the relevant resonance element 30, for example, in a clockwise direction by inserting the coupling pins 522 (FIGS. 1 and 2) of the driver device 50 into the through holes 322 of the planar portion 32 of the resonance element 30. As a result, the male thread 342 of the support 34 of the resonance element 30 is tightened to the female thread 24 of the housing 20, whereby the resonance element 30 is installed on the bottom of the housing 20.

In terms of installation, the above-described method with the resonance element 30 seems somewhat similar to the conventional method of screw interconnection. However, different from the construction of the embodiments of the present disclosure, employing the conventional method of screw interconnection alone would lead to a conceptual structure with a slot screw drive or a cross screw drive formed at the center of the planar portion 32 of the resonance element 30 so that the drive can be engaged with a typical screwdriver. Such conceptual structure requires the planar portion 32 to be relatively thick in order to form grooves into the aforementioned slot screw drive or cross screw drive. In comparison, according to some embodiments of the present disclosure, the structure adopting the through hole 322 may make the planar portion 32 of the resonance element 30 very thin.

For the resonance element 30, note that the planar portion 32 and the support 34 form the C component and the L component of the relevant filter, respectively. For example, in order to reduce the filter size while maintaining the same L value as compared with a filter of a larger size, the support 34 needs to be designed to have a small diameter. In some embodiments of the present disclosure, the thickness of the planar portion 32 of the resonance element 30 is designed to be very thin, and at the same time, the support 34 of the resonance element 30 required to stably support the planar portion 32 can be designed to have a further reduced diameter. For example, the thickness (reference symbol 't' in FIG. 2) of the planar portion 32 may be designed to be, for example, about 0.5 mm or less. In addition, the planar portion 32 of the resonance element 30 may be installed close to the cover 10 to increase the value of C component. For example, the distance (reference symbol in FIG. 2) between the planar portion 32 and the cover 10 may be designed to be about 0.5 mm. As illustrated in FIG. 2, for example, extensions are formed from the edges of the planar portion 32 to extend downward along the side walls of the cavity, and these extensions help to increase the value of C of the planar portion 32.

In addition, the resonance element 30 may be generally made of a material such as iron (alloy) which is thereafter silver-plated according to some embodiments of the present disclosure, which is for the purpose of compensating for characteristic changes due to changes in the temperature of the filter. Specifically, in the environment of using the radio frequency filter, the sizes of the cavity and the resonance element may expand as a whole as the temperature rises, which shifts the center frequency of the filter to a lower frequency band. In some embodiments of the present disclosure, the resonance element is made of a material having a lower thermal expansion coefficient (for example, iron) than the material of the housing and the cover (for example, an aluminum alloy) to increase the distance between the cover and the resonance element when the temperature rises so as to compensate for the change in the center frequency of the filter into the lower frequency band. The resonance element 30 may be made of other materials such as copper (Cu), brass (Bs) or the like which has a thermal expansion coefficient lower than that of the aluminum alloy.

The cover 10 may have a conventional structure applicable to typical radio frequency filters with cavities. For example, the structure may be similar to that illustrated in Korean Laid-Open Patent Publication No. 10-2014-0026235 (entitled 'Radio Frequency Filter with Cavity, published Mar. 5, 2014, and invented by PARK, Nam Sin et. al.) filed by the present applicant. Korean Laid-Open Patent Publication No. 10-2014-0026235 discloses a simplified filter structure to enable frequency tuning without using a conventional coupling structure of tuning screws and fastening nuts. The cover 10 according to some embodiments of the present disclosure is formed with one or a plurality of recesses or depressions 12 (FIGS. 1 and 2) as disclosed in Korean Laid-Open Patent Publication No. 10-2014-0026235. Frequency tuning can be performed by forming a plurality of dot peens by marking or pressing on the depressions 12 by way of marking pins of an external marking device.

According to other embodiments of the disclosure, on the one hand, a more generalized frequency tuning scheme is applicable to the cover 10 to form a frequency tuning screw and a fastening nut rather than using the above-described depression structure arrangement 12. The structure adopting the frequency tuning screw and the fastening nut described above, however, may be relatively complicated so that the resultant structure might be harder to be reduced in size. In addition, as the smaller gap between the cover 10 and the resonance element 30 may make the tuning even tougher, it may not be easy to adopt the tuning screw and the fastening nut.

Figure 4:
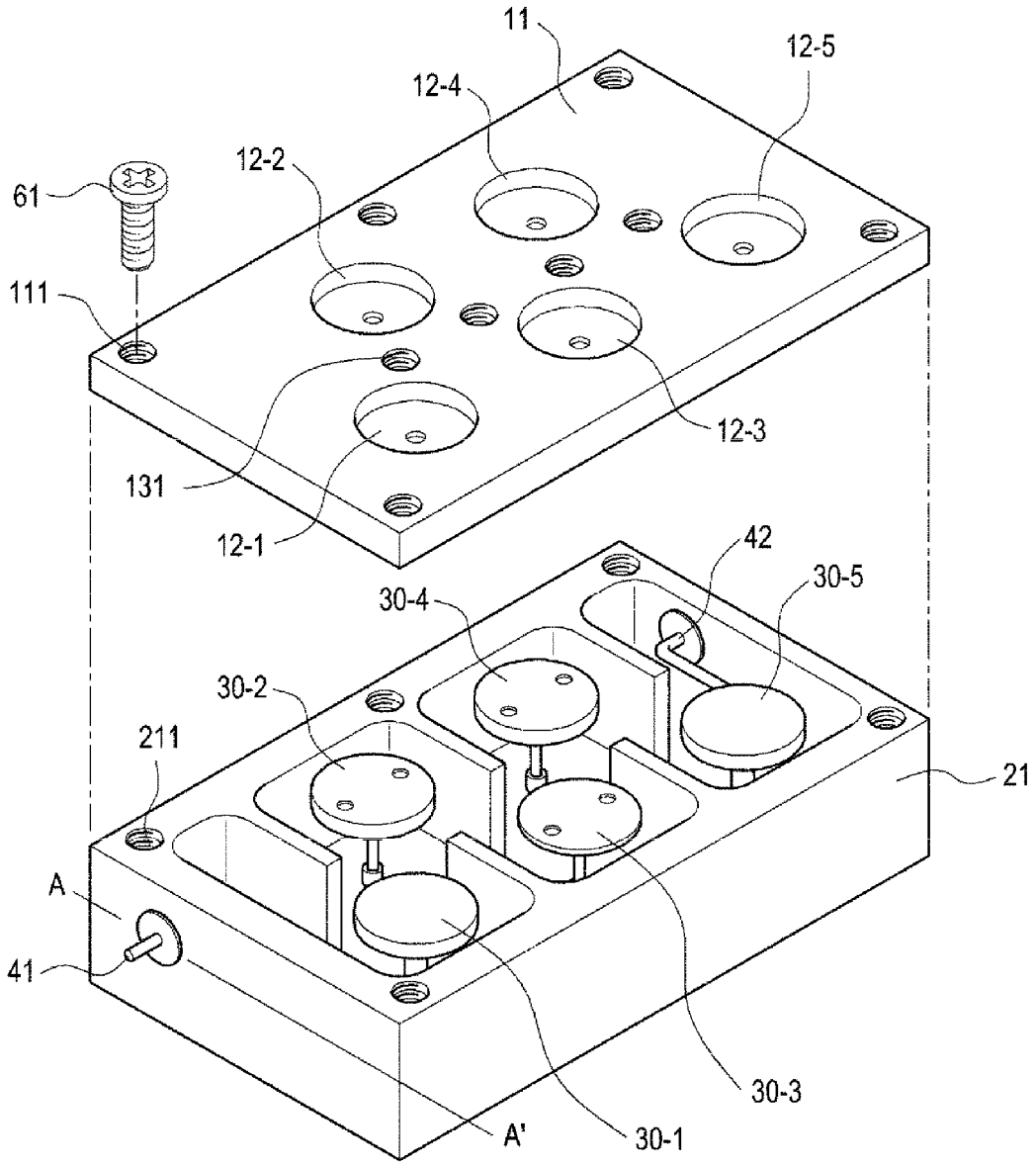
FIG. 4 is a partially exploded perspective view of a radio frequency filter having a cavity according to a second embodiment of the present disclosure.

FIG. 4 is a partially exploded perspective view of a radio frequency filter having a cavity according to a second embodiment of the present disclosure. Referring to FIG. 4, the radio frequency filter having a cavity according to the second embodiment of the present disclosure is provided with an enclosure that has a hollow internal space and a plurality of (five in the example of FIGS. 4 and 5) cavities isolated from the outside. The enclosure is formed by a housing 21 that has five cavities and an opening at one side (e.g., the upper side), and a cover 11 for enclosing the open side of the housing 21.

FIG. 4 illustrates an example where five cavities are connected in multiple, e.g., five, stages in the housing 21. Specifically, the five cavities are sequentially interconnected in FIG. 4. Each of the cavities of the housing 21 has one of the resonance elements 30-1, 30-2, 30-3, 30-4 and 30-5 at its center, respectively. In addition, in order to facilitate a sequential coupling of the respective cavities in the housing 21, coupling windows are provided in the form of connecting passages between the cavities having the sequential interconnection structure. The coupling windows may be implemented at positions on the partition walls between the cavities by removing a certain portion of the partition walls with predetermined sizes.

In the configuration shown in FIG. 4, at least some of the resonance elements 30-1, 30-2, 30-3, 30-4 and 30-5 may have the structure set forth in the first embodiment of the present disclosure as provided in FIGS. 1 to 3. For example, each of the second, third and fourth resonance elements 30-2, 30-3 and 30-4 has a planar portion having a circular planar shape, and a support structure as shown in FIGS. 1 to 3. The planar portion may be formed to have at least two through holes, and the support may be structured to be fixed to the bottom of the housing by fastening a screw.

FIG. 4 shows that, for example, the second and fourth resonance elements 30-2, 30-4 have, like the structure shown in FIGS. 1 to 3, extensions extending from the side edges of the planar portions downward along the side walls of the cavity, while the third resonance element 30-3 has no such extension. In addition, the first and fifth resonance elements 30-1, 30-5 may have a typical resonance element structure. As described above, in some embodiments of the present disclosure, resonance elements having a typical structure may be used in combination with resonance elements having the structure shown in FIGS. 1 to 3. It is understood that, in other embodiments of the present disclosure, all resonance elements may have the same structure as that shown in FIGS. 1 to 3.

Meanwhile, the cover 11 may be formed with first to fifth depressions 12-1, 12-2, 12-3, 12-4 and 12-5 for frequency tuning corresponding to the respective resonance elements provided in their cavities. The cover 11 may be additionally formed with a plurality of coupling/tuning threaded holes 131 at positions in the cover 11 corresponding to coupling windows, which are connection path structures between the respective cavities of the housing 21. A coupling/tuning screw (not shown) for tuning/coupling may be inserted into the coupling/tuning thread hole 131 at an appropriate depth, so as to allow performing the tuning process of the coupling. At this time, the coupling tuning screw may be fixed at a proper position by using separate adhesive such as epoxy resin.

The cover 11 and the housing 21 may be fastened together by fastening screws 61. For example, through holes 111 for screw fastening are formed at appropriate positions of the cover 11, and a plurality of recesses 211 for screw fastening are formed in the housing 21 at positions corresponding to the through holes 111. The cover 11 and the housing 21 may be coupled by engaging each of the fastening screws 61 through the corresponding through holes 111 of the cover 11 into the respective recesses 211 of the housing. It should be understood that the cover 11 and the housing 21 may also be joined by laser welding, soldering or the like.

Figure 5:
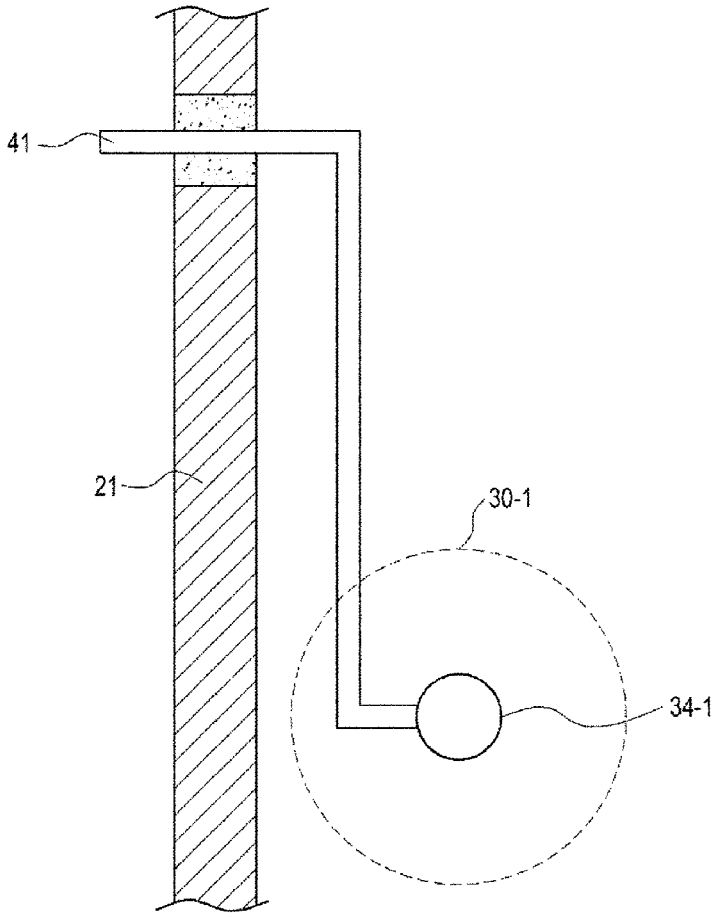
FIG. 5 is a partial sectional view taken along line A-A' in FIG. 4.

Furthermore, as shown in FIG. 4, the radio frequency filter may have an input terminal 41 and an output terminal 42 attached thereto via through holes each formed on a side wall of the housing 21 so that the terminals 41, 42 are respectively connected to the cavity at the input end and the cavity at the output end. FIG. 5 shows the input terminal 41 and the first resonance element 30-1 when they are fastened together so that an extension line of the input terminal 41 is directly connected to a support 34-1 of the first resonance element 30-1 through a side wall of the housing 21. It is understood that the radio frequency filter may be configured so that the extension line of the input terminal is connected to a support 34-1 by a non-contact coupling method.

As described above, a radio frequency filter having a cavity is configured according to some embodiments of the present disclosure, although there are various other embodiments and modifications in the present disclosure. For example, in the above description, the number of through holes formed in the planar portion of the resonance element is two, but different numbers of through holes such as three or four of them may be formed in different configurations of the radio frequency filter.

In the second embodiment, for example, a filter structure is disclosed as having five cavities, although other filter structures may be configured to have two to four or more than six cavities. It is understood that, as is relevant to the filter structure, at least one or more resonance elements may be implemented as necessary so as to have the structure according to the first embodiment.

As described above, there are various modifications and alterations of the present disclosure, and therefore, the scope of the present disclosure is not defined by the embodiments described, but by the claims and the equivalence of the claims.

What is claimed is:

1. A radio frequency filter, comprising:

a housing comprising a cavity, wherein the housing is open at a top side thereof;

a cover which covers the top side of the housing; and a resonance element disposed in the cavity, wherein the resonance element comprises a planar plate and a support, wherein the support comprises a lower end to be fixed to the housing and a upper end to support the planar plate, wherein the planar plate of the resonance element has at least two through holes, wherein the lower end of the support has a male thread for screw fastening, and wherein the housing has a female thread to be screw fastened with the male thread provided at the lower end of the support.

2. The radio frequency filter of claim 1, wherein the at least two through holes are formed so as to be connected to a driver device and rotate the resonance element according to rotation of the driver device, and the driver device comprises at least two pins disposed corresponding to the at least two through holes formed on the planar plate, wherein the at least two pins are configured to be inserted in the at least two through holes for an engagement with the at least two through holes.

3. The radio frequency filter of claim 2, wherein the cover has at least one depression provided at a position corresponding to the resonance element for allowing a frequency tuning.

4. The radio frequency filter of claim 2, wherein the resonance element is made of a material having a thermal expansion coefficient lower than a thermal expansion coefficient of a material constituting the housing.

5. The radio frequency filter of claim 1, wherein the resonance element is made of a material having a thermal expansion coefficient lower than a thermal expansion coefficient of a material constituting the housing.

6. The radio frequency filter of claim 1, wherein the cover has at least one depression provided at a position corresponding to the resonance element for allowing a frequency tuning.

7. The radio frequency filter of claim 1, wherein the housing further comprises another cavity and another resonance element disposed in the another cavity.

8. The radio frequency filter of claim 7, wherein the cover has at least one depression at a position corresponding to the resonance element for allowing a frequency tuning.

9. The radio frequency filter of claim 7, wherein the resonance element is made of a material having a thermal expansion coefficient lower than a thermal expansion coefficient of a material constituting the housing.

10. The radio frequency filter of claim 1, wherein the planar plate has a thickness of 0.5 mm or less.

11. The radio frequency filter of claim 10, wherein the cover has at least one depression at a position corresponding to the resonance element for allowing a frequency tuning.

12. The radio frequency filter of claim 10, wherein the resonance element is made of a material having a thermal expansion coefficient lower than a thermal expansion coefficient of a material constituting the housing.

* * * * *